United States Patent [19]

Furuta et al.

[11] Patent Number: 4,530,621

[45] Date of Patent: Jul. 23, 1985

[54] SHIELD DRIVING PROCESS FOR ENLARGEMENT

[75] Inventors: Toshio Furuta; Nobuhiko Kawamoto; Akira Honma, all of Tokyo, Japan

[73] Assignee: Mitsui Kensetsu Kabushiki Kaisha, Tokyo, Japan

[21] Appl. No.: 558,973

[22] Filed: Dec. 7, 1983

[30] Foreign Application Priority Data

Dec. 8, 1982 [JP] Japan ..... 57-215322

[51] Int. Cl.[3] ..... E21D 11/00; E21D 9/06

[52] U.S. Cl. ..... 405/150; 405/146; 405/138; 405/132

[58] Field of Search ..... 405/138-146, 405/150, 132; 175/53, 61, 62, 350, 319, 263, 264, 108; 299/31

[56] References Cited

U.S. PATENT DOCUMENTS

| | | | |
|---|---|---|---|
| 1,278,932 | 9/1918 | Hughes | 175/62 X |
| 2,743,087 | 4/1956 | Layne et al. | 175/350 X |
| 2,903,252 | 9/1959 | Ebeling | 175/53 |
| 3,523,426 | 8/1970 | Lauber | 299/31 X |

FOREIGN PATENT DOCUMENTS

| | | | |
|---|---|---|---|
| 459285 | 9/1968 | Switzerland | 405/141 |

*Primary Examiner*—Dennis L. Taylor

*Attorney, Agent, or Firm*—Birch, Stewart, Kolasch & Birch

[57] ABSTRACT

A shield driving apparatus and process for enlarging the periphery of a predetermined region of an existing tunnel lined with a primary shield segment assembly wherein some segments of such a region of the primary shield segment assembly that correspond to the predetermined region to be enlarged are removed in series along the axial direction of the existing tunnel. The exposed ground resulting from the removal of the primary shield segment assembly is excavated to form a cavity therein. A circumferentially driving shield machine is positioned in the cavity and is mounted to bridge between the two guide rings provided at both end portions of the predetermined region and along the periphery of the existing tunnel. Circumferential segments are mounted to bridge between the two rings and are fixedly pile one upon another on the rear surface of the shield machine so as to form a series thereof connected to the shield machine while the shield machine is driven forward step by step in the circumferential direction of the existing tunnel along on the guide rings by applying a pressure to the rearmost one of the piled circumferential segments progressively formed. The enlargement of the periphery of the predetermined region lined with a ring of a series of circumferential segments is thus completed.

7 Claims, 11 Drawing Figures

SHIELD DRIVING PROCESS FOR ENLARGEMENT

BACKGROUND OF THE INVENTION

1. Field of the Invention

This invention relates to a shield driving process for enlargement wherein the periphery of an existing tunnel already constructed and lined with a primary shield segment assembly is enlarged by a circumferentially driving shield machine.

2. Description of Background Art

A process for enlarging a portion of an existing tunnel has been hithertofore known wherein a shaft is extended from the surface of the earth so as to reach a predetermined region to be enlarged. Thereafter, the periphery of the existing tunnel is enlarged by utilizing the shaft as a base and the shaft is refilled with soil.

In another process, a cylindrical shield machine is driven along an ordinary tunnel and reaches a predetermined region to be enlarged. A cutter head of the shield machine is expanded with a special enlarging cutter member. Thereafter, the forward driving of the shield machine is carried out by operation of the cutter head with the special enlarging cutter member so that enlargement of the predetermined region of the tunnel can be performed.

However, the shaft process is defective in that extra work is required for constructing the shaft and refilling the shaft. In addition, this process requires a company to acquire the land for constructing the shaft. The shield machine process is defective in that if the increased diameter of the cutter head extends beyond a predetermined size, the cutter head cannot operate against the earth pressure acting thereon. In addition, this process requires work for attaching or detaching of the enlarging cutter member in order to excavate the enlarged tunnel or excavate the ordinary tunnel again. Further, the work required for constructing an ordinary tunnel and the work required for enlarging a portion of the ordinary tunnel cannot be carried out at the same time.

SUMMARY AND OBJECTS OF THE INVENTION

This invention has for its object to provide a driving process for enlargement of a tunnel free from the above defects. In more detail, a process is disclosed for enlarging the periphery of a predetermined portion of an existing tunnel already constructed and lined with a primary shield segment assembly. Some segments of the region of the primary shield segment assembly which corresponds to the predetermined region to be enlarged are removed in series along the axial direction of the existing tunnel. The exposed ground resulting from this removal thereof is excavated to form a cavity therein. A circumferentially shield machine is positioned in the cavity and is mounted to bridge between the two guide rings provided at both end portions of the predetermined region and extending along the periphery of the existing tunnel. Circumferential segments are mounted to bridge between the two rings and are fixedly piled and placed one upon another on the rear surface of the shield machine so as to form a series thereof connected to the shield machine while the shield machine is driven forward step by step in the circumferential direction of the existing tunnel along guide rings by applying a pressure to the rearmost one of the piled circumferential segments progressively formed. Thereafter, the enlargement of the periphery of the predetermined region lined with a ring consisting of a series of circumferential segments is completed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
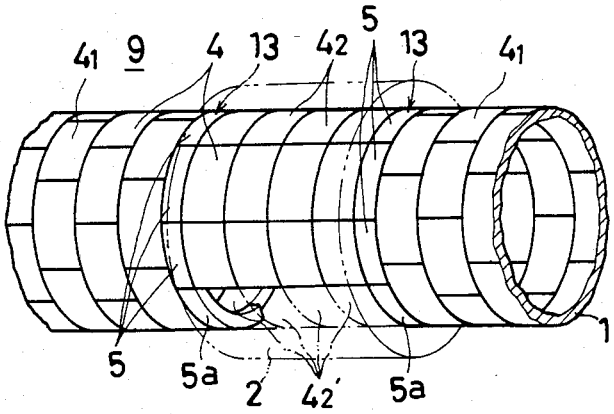
FIG. 1 is a perspective view of a portion of an ordinary existing tunnel lined with a primary shield segment assembly, including one example of the invention process and apparatus.

Referring to the drawings, an existing tunnel 1 is already constructed through a mountain or in the ground 9 and is lined with primary shield segments 4. A guide ring 13 comprising a group of guide segments 5 and having an annular guide groove 10 is incorporated therein around the circumference of the existing tunnel 1 at each boundary between a segment region $4_1$ located outside the predetermined enlargement region 2 of the existing tunnel 1 and a segment region $4_2$ existing inside the region 2.

At first, in order to excavate the circumferential ground of the predetermined region 2 for enlargement thereof aligned lower side segments $4_2'$, among the segments $4_2$ lining the predetermined region 2, are removed in series along the axial direction of the existing tunnel 1. In addition, a lower one-sided guide segment 5*a*, amount the guide segments 5 constituting the guide ring 13 at each boundary, is removed as shown in FIG. 1. Thereafter, as shown in FIG. 4(*a*), a steel constructed square frame 6 which may be disassembled and includes a through opening in the upper and lower directions is placed on the exposed ground 8 which is exposed as a result of the foregoing removal of the segments $4_2'$.

As illustrated in FIG. 4(*b*), the steel constructed frame 6 is pushed into the ground 8 by expansion of a jack means 7, and the ground soil surrounded by the frame 6 is removed Thereafter, a second steel constructed square frame 6 is positioned on the foregoing frame 6 and the jack means 7 is again expanded to push the second frame 6 into the ground 8. When the lower steel constructed frame 6 reaches a predetermined depth and the ground soil surrounded by the piled frames is removed, a cavity 14 serving as a starting base is formed. At this stage, a retaining plate 6*a* is fixedly applid to the bottom of the lower frame 6 and side plates 6*b* of the piled frames 6 that are located in the way of a forward driving direction of a shield machine 15 are removed.

Figure 5:
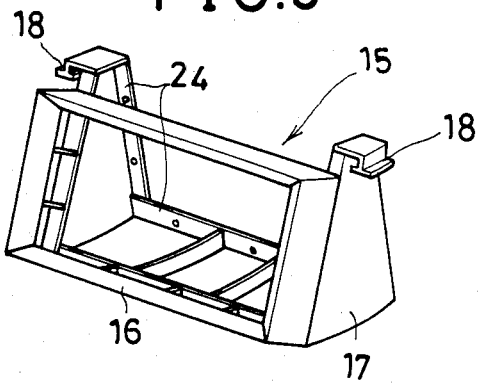
FIG. 5 is a perspective view of a shield machine.
Figure 6:
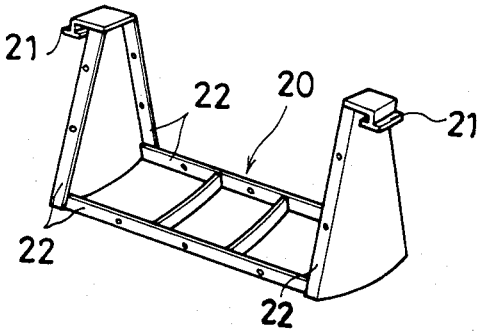
FIG. 6 is a perspective view of a circumferential segment.

The shield machine 15 comprises, as shown in FIG. 5, a nearly rectangular frame type cutter portion 16, and a U-shaped frame type body portion 17. A circumferential segment 20 comprises, as shown in FIG. 6, a U-shaped frame body which is similar to the body portion 17 of the shield machine 15. Both the body portion 17 and the circumferential segment 20 are provided at both of the respective upper end portions with T-shaped tabs 18, 18 and 21, 21.

The shield machine 15 and the circumferential segment 20 are placed in the foregoing cavity 14 and are mounted, in order, to bridge between the two guide rings 13, 13. In this manner, the cutter portion 16 and the segments 20 are ready to be driven for enlargement of the diameter of the predetermined region 2 of the existing tunnel.

Figure 2:
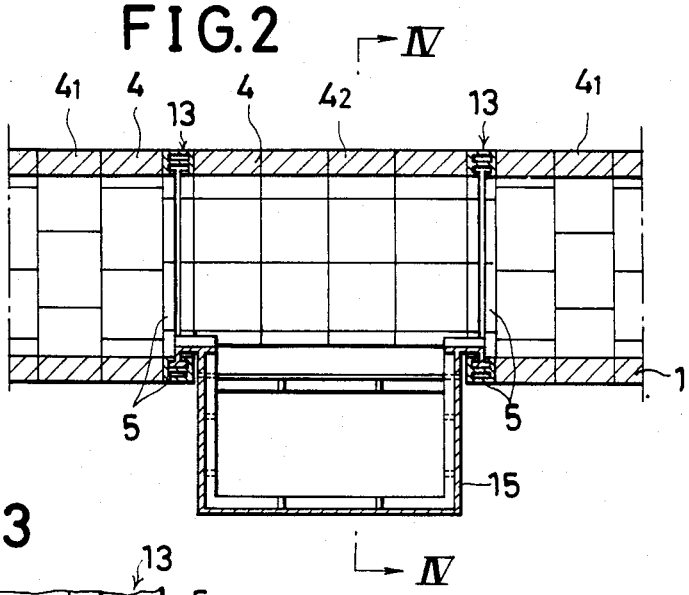
FIG. 2 is a longitudinal sectional side view of the same.
Figure 3:
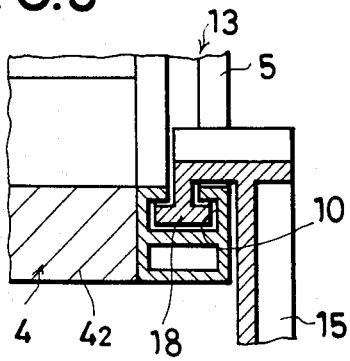
FIG. 3 is an enlarged view of a portion thereof.
Figure 4A:
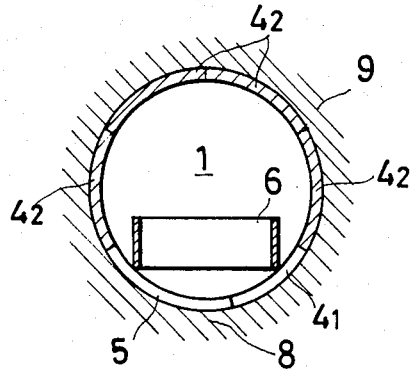
FIGS. 4(*a*)–(*f*) are sectional views taken along the line IV—IV in FIG. 2 and showing respective driving steps of the invention process and apparatus.
Figure 4B:
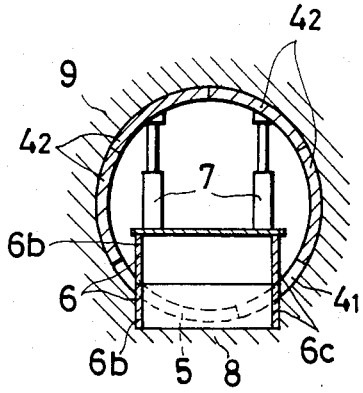
Figure 4C:
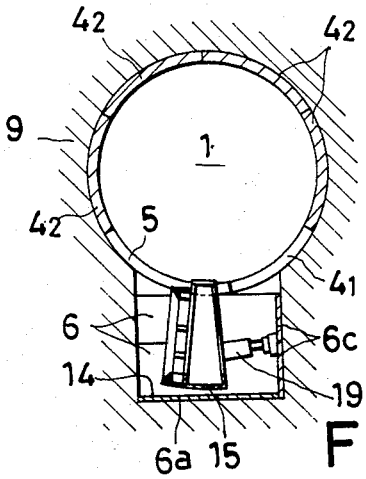
Figure 4D:
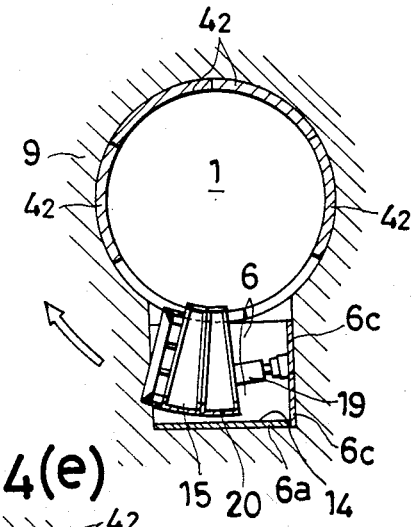
Figure 4E:
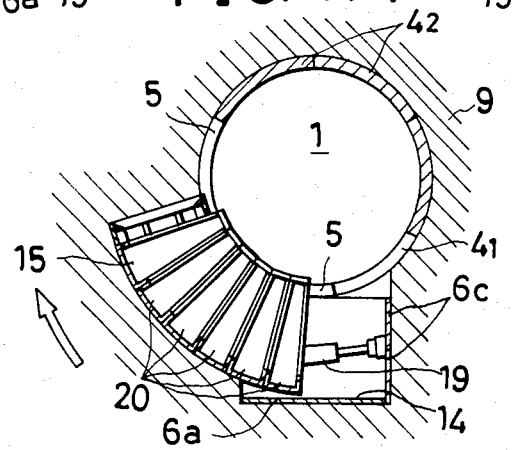
Figure 4F:
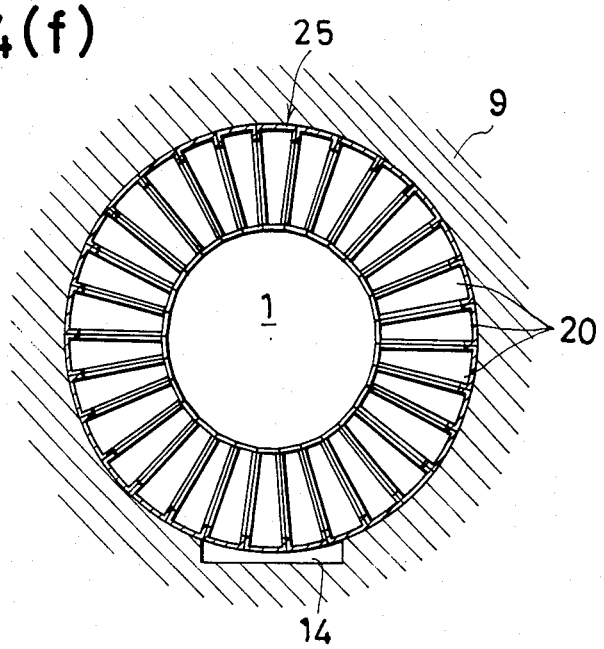

In more detail, with the two guide rings 13, 13 being opened by the removal of the two lower guide segments 5*a*, 5*a* from the primary shield segments 4 as mentioned above, the shield machine 15 is mounted to bridge therebetween in such a manner that the T-shaped tabs 18, 18 thereof are brought into engagement with the guide grooves 10, 10 of the guide rings 13, 13 as illustrated in FIG. 2 and FIG. 4(*c*). Thereafter, behind the shield machine 15, the circumferential segment 20 is mounted to bridge between the two guide rings 13, 13 in such a manner that the T-shaped tabs 21, 21 thereof are brought into engagement with the guide grooves 10, 10 of the guide rings 13, 13. The shield machine 15 and the circumferential segment 20 behind the same are combined together in such a manner that a joining edge 22 of the circumferential segment 20 and a joining edge 24 of the shield machine 15 are fastened together by means of bolts or the like as illustrated in FIG. 4(*d*).

Thereafter, the segments $4_2$ located ahead of the shield machine 15 are removed in order and the shield machine 15 and the circumferential segment 20 connected thereto are pushed forward by a jack means 19 attached to the rear side plates 6*c* of the frames 6. In this manner, the shield machine 15 is driven forward in the direction shown by an arrow C, so that the shield machine 15 is thrust into a facing circumferential ground 9 located ahead thereof. The ground soil entering the shield machine 15 is removed by any desired digging means such as an earth auger or the like provided at the center of the shield machine.

Behind the circumferential segment 20, additional circumferential segments 20, 20 . . . 20 are mounted in order to bridge between the two guide rings 13, 13 in such a manner that the T-shaped tabs 21, 21 of each thereof are brought into engagement with the guide rings 13, 13. In addition, the circumferential segments 20, 20 . . . 20 are jointed together, in order, at their respective mutually adjacent joining edges 22, 22 . . . 22, and the shield machine 15 is further driven forward by applying a pushing force from the jack means 19 to the rearmost one of the series of the circumferential segments 20. Thus the resultant enlarged portion formed in the rear of the shield machine 15 is lined with the series of circumferential segments as illustrated in FIG. 4(*e*). By this way, the enlarging work of the predetermined region 2 of the ordinary tunnel 1 can proceed by circumferentially driving the shield machine 15 in the direction of the arrow C and discharging of the ground soil while mounting additional circumferential segments on the two guide rings 13, 13.

Finally, the plate 6*a* and side plates 6*c* of the steel constructed frames 6 are removed. Thereafter, the shield machine 15 is returned to the interior of the cavity 14 and is detached from the front circumferential segment 20 and the guide rings 13, 13. Another circumferential segment 20 is brought into engagement at its T-shaped tabs 21, 21 with the grooves 10, 10 of the ring segments 5*a*, 5*a* previously removed. The guide segments 5*a*, 5*a* thus engaged with the segment 20 are again fixedly returned to their original positions to close the rings 13, 13. Thus, the segment 20 is fixed to both ends of the series of the circumferential segments 20, 20 . . . 20 so that there is formed a circle of enlargement of the predetermined region defined by a circle of a series of circumferential segments 20, 20 . . . 20 and, consequently, an enlarged tunnel 25 is formed as illustrated in FIG. 4(*f*).

In the foregoing example, in order to facilitate the mounting of the shield machine 15 and the circumferential segments 20 on the two guide rings 13, 13, each of the guide rings 13, 13 is composed of dividable pieces. In this manner, the shield machine 15 and the circumferential segments 20 are mounted thereon. The dividable piece thereof is once detached and is then attached again after the mounting thereof. However, depending on the types of the guide ring 13 and the types of the tabs 18, 18, 21, 21 of the shield machine 15 and the circumferential segment 20, the ring 13 may be modified into one which is not a dividable and detachable type.

Additionally, in the foregoing example, each guide ring 13 is previously disposed at the boundary between the segment assembly regions $4_2$ and $4_1$ existing inside and outside the predetermined region 2. In another embodiment, a modification may be considered wherein after the two ring segments of the primary shield segment assembly located on both ends of the predetermined region 2 to be enlarged are removed, the guide rings 13, 13 may be applied to those positions.

Thus, according to this invention, the periphery of a predetermined region of an existing tunnel is enlarged by circularly driving the shield machine along the guide rings. Accordingly, the work for constructing a shaft and refilling the shaft, as in the conventional process, becomes unnecessary. An enlargement of the predetermined region of the tunnel can be performed very easily. Additionally, the work for constructing an ordinary tunnel and the work for enlarging the ordinary tunnel can be carried out simultaneously. Furthermore, the working property is excellent because mounting of the shield machine and the circumferential segments on the guide rings and applying a driving force thereto can be carried out at the same place.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A shield driving process for enlarging the periphery of a predetermined region of an existing tunnel lined with a primary shield segment assembly comprising the following steps:

removing some segments of a region of a primary shield segment assembly that correspond to the predetermined region to be enlarged in series along the axial direction of the existing tunnel;

exposing ground resulting from the removal of the primary shield segment assembly;

excavating the ground to form a cavity therein;

circumferentially driving a shield machine positioned in the cavity and mounted to bridge between two guide rings provided at both end portions of the perdetermined region and along the periphery of the existing tunnel;

mounting circumferential segments to bridge between the two rings and being fixedly piled one upon another on a rear surface of the shield machine so as to form a series thereof connected to the shield machine while the shield machine is driven forward step by step in the circumferential direction of the existing tunnel along on the guide rings;

applying pressure to the rearmost one of the piled circumferential segments progressively formed; and enlarging the periphery of the predetermined region lined with a ring of a series of circumferential segments.

2. A shield machine for enlarging the periphery of a predetermined region of an existing tunnel lined with a primary shield segment assembly comprising:

guide rails operatively positioned within said existing tunnel and being spaced a predetermined distance relative to each other;

a circumferential driving shield machine operatively connected to said guide rails and being spaced outside the outer peripheral surface of said primary shield segment assembly;

drive means for imparting circumferential motion to said circumferential driving shield machine; and circumferential segments operatively connected to said circumferential driving shield machine and said drive means;

whereby advancing said circumferential driving shield machine outside the outer peripheral surface of said primary shield segment assembly and operatively positioning said circumferential segments therearound enlarges said existing tunnel.

3. A shield machine according to claim 2, wherein said circumferential driving shield machine and said circumferential segments include tabs operatively engageable with said guide rails to guide the circumferential movement thereof.

4. A shield machine according to claim 2, wherein said drive means includes a fluid actuated cylinder for advancing said circumferential driving shield machine in a step by step movement.

5. A shield machine according to claim 2, wherein said circumferential segments are bolted together to form said enlarged predetermined region.

6. A shield machine according to claim 2, wherein said circumferential segments are pie-shaped segments.

7. A shield machine according to claim 2, wherein said circumferential driving shield machine includes a cutter portion mounted on one side thereof.

* * * * *